US010731360B2

(12) United States Patent
Bordin

(10) Patent No.: US 10,731,360 B2
(45) Date of Patent: Aug. 4, 2020

(54) SPACER FOR LAYING TILES, BRICKS AND THE LIKE WITH THE INTERPOSITION OF GAPS

(71) Applicant: PROGRESS PROFILES SPA, Asolo (IT)

(72) Inventor: Dennis Bordin, Asolo (IT)

(73) Assignee: PROGRESS PROFILES SPA, Asolo (IT)

( * ) Notice: Subject to any disclaimer, the term of this patent is extended or adjusted under 35 U.S.C. 154(b) by 0 days.

(21) Appl. No.: 16/398,606

(22) Filed: Apr. 30, 2019

(65) Prior Publication Data

US 2019/0338536 A1 Nov. 7, 2019

(30) Foreign Application Priority Data

May 3, 2018 (IT) ..... 102018000005016

(51) Int. Cl.
*E04F 21/00* (2006.01)
*E04F 21/20* (2006.01)

(52) U.S. Cl.
CPC ..... *E04F 21/0092* (2013.01); *E04F 21/20* (2013.01)

(58) Field of Classification Search
CPC ... E04F 21/0092; E04F 21/20; E04F 21/1877; E04F 15/02022
USPC ..... 52/749.11
See application file for complete search history.

(56) References Cited

U.S. PATENT DOCUMENTS 4,953,341 A * 9/1990 Joos ..... E01C 5/006 33/404
4,955,142 A * 9/1990 Rieck ..... E04F 21/0092 33/526
5,288,534 A 2/1994 Tavshanjian
D492,210 S * 6/2004 Shilo ..... D10/64
7,257,926 B1 * 8/2007 Kirby ..... E04F 21/0092 33/526
8,607,468 B2 * 12/2013 Hillebrandt ..... E04F 21/22 33/527
9,121,187 B1 * 9/2015 Bunch ..... E04F 21/0092
D848,820 S * 5/2019 Dahill ..... D8/354
D857,482 S * 8/2019 Li ..... D8/354
2004/0060184 A1 * 4/2004 Shilo ..... E04F 21/0092 33/526
2009/0126213 A1 * 5/2009 Tavy ..... E04F 21/0092 33/527

(Continued)

FOREIGN PATENT DOCUMENTS

AU 2002332961 B2 3/2007
RU 2312958 C1 12/2007
RU 149447 U1 1/2015

OTHER PUBLICATIONS

IT Search Report dated Dec. 14, 2018 re: Application No. IT 2018000005016, pp. 1-8.

*Primary Examiner* — Jeanette E Chapman
(74) *Attorney, Agent, or Firm* — Cantor Colburn LLP

(57) ABSTRACT

A spacer for laying tiles, bricks and the like with the interposition of gaps includes a plate-like body open internally with at least one spacing protrusion that protrudes outward from the body and defines the width of a respective gap. At least one first spacing protrusion protrudes outwardly and from at least one of the two opposite faces of the body along an arrangement that is perpendicular to the arrangement of the body.

4 Claims, 3 Drawing Sheets

(56) References Cited

U.S. PATENT DOCUMENTS

2015/0233129 A1* 8/2015 Gamisans Berenguer .....
E04F 21/1844
52/749.11

2016/0186449 A1 6/2016 Lee

* cited by examiner

SPACER FOR LAYING TILES, BRICKS AND THE LIKE WITH THE INTERPOSITION OF GAPS

CROSS-REFERENCE TO RELATED APPLICATIONS

This application is related to and claims the benefit of Italian Patent Application No. 102018000005016, filed on May 3, 2018, the contents of which are herein incorporated by reference in their entirety.

TECHNICAL FIELD

The present disclosure relates to a spacer for laying tiles, bricks and the like with the interposition of gaps.

BACKGROUND

In the laying of floor surfaces and coverings composed of tiles, bricks or slabs, a difficulty is typically encountered in spacing such elements apart equidistantly in order to create the gaps.

Nowadays leveling spacers are known for laying tiles, bricks and the like, which comprise:

- a base, to be arranged below two laterally adjacent tiles and from which spacing protrusions extend to define the width of the gaps, and locator abutments for the edges of the tiles;
- a threaded stem, which extends at right angles at the base and is connected to it in at least one facilitated breakage point;
- a knob for fastening and removing the stem, which comprises a female threaded portion adapted to be screwed to the stem.

The knob is provided with a plate-like part which is designed to be pressed during clamping against the tiles in a first step of laying the tiles in order to immobilize the edges and corners of multiple tiles arranged on the base.

Once the fixing of the tiles to the underlying surface is completed, the stem is removed by way of further rotation by screwing the knob on the threaded stem. In fact, this further rotation of the knob in the same direction of screwing causes the traction in a direction perpendicular to the arrangement of the tiles of the threaded stem, until the breakage of the breaking points, with consequent removal of the stem and of its tabs from the base.

The base is embedded and hidden by the material with which the gaps between the tiles are made.

This and similar conventional spacers have a considerable drawback in that when laying the base, they remain, unrecoverable, inside the gaps, thus constituting a weak point for the correct adhesion of the adhesive and of the putty between the tiles, marble and/or any other material.

For the same reason, conventional spacers have a cost that influences the overall costs of laying tiles and the like.

SUMMARY

The aim of the present disclosure is to provide a spacer that is capable of improving the known art in one or more of the above mentioned aspects.

Within this aim, the disclosure provides a spacer that is capable of ensuring the correct laying of tiles, bricks or the like, without parts that remain unrecovered inside the gaps.

The disclosure also provides a spacer that makes it possible to lay the tiles according to the correct leveling.

The disclosure further provides a spacer that, if necessary, can be integrated with conventional spacers in order to reduce their drawbacks and in order to obtain better leveling results.

The disclosure provides a spacer that makes it possible to reduce the costs of material in the laying of tiles.

The present disclosure further overcomes the drawbacks of conventional spacers in an alternative manner to any existing solutions.

The disclosure provides a spacer that is highly reliable, easy to implement, and at low cost.

This aim and these and other advantages which will become better apparent hereinafter are achieved by providing a spacer for laying tiles, bricks and the like with the interposition of gaps, wherein the spacer comprises a plate-like body which is open internally with at least one spacing protrusion that protrudes outward from said body and defines the width of a respective gap.

BRIEF DESCRIPTION OF THE DRAWINGS

Further characteristics and advantages of the disclosure will become better apparent from the detailed description that follows of a preferred, but not exclusive, embodiment of the spacer according to the disclosure, which is illustrated by way of non-limiting example in the accompanying drawings wherein.

DETAILED DESCRIPTION OF THE DRAWINGS

Figure 1:
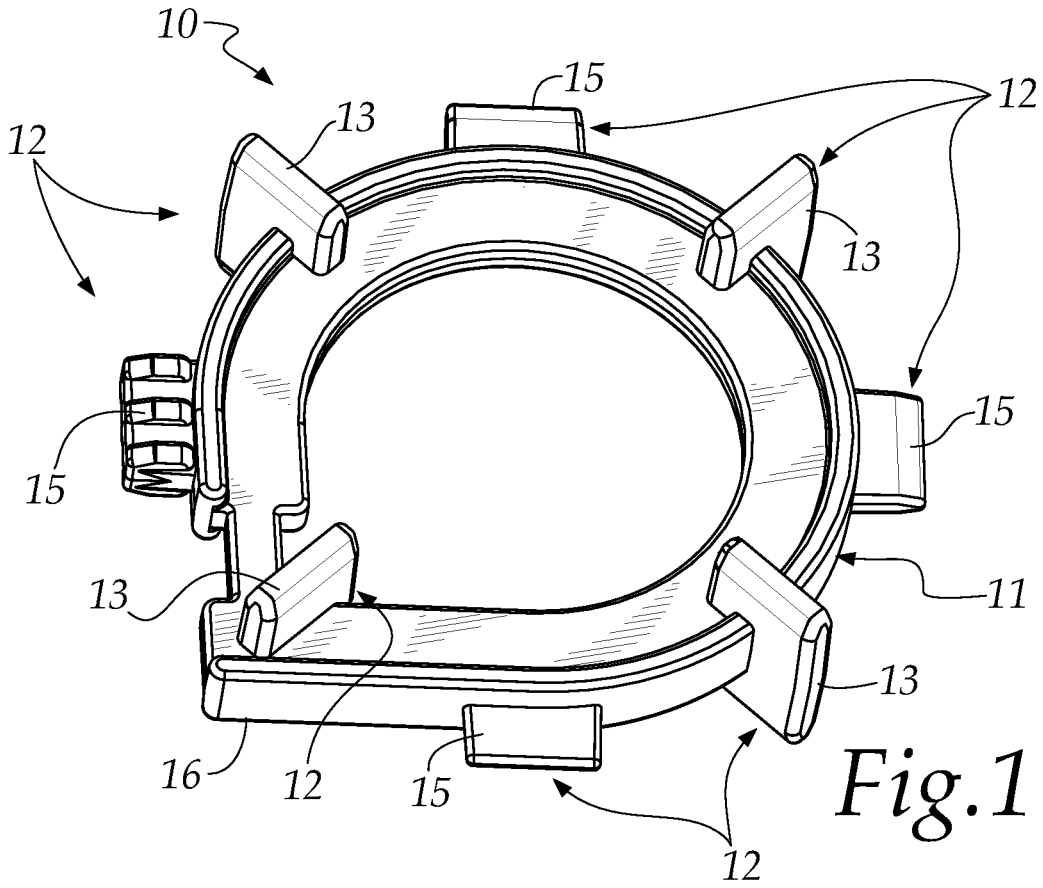
FIG. 1 is a perspective view of the spacer according to the disclosure.
Figure 2:
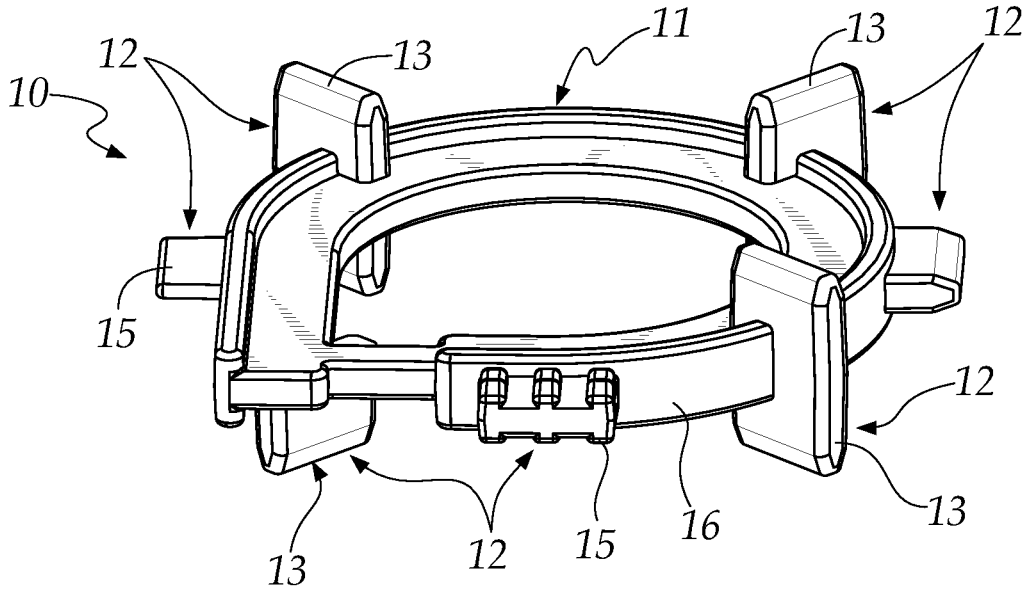
FIG. 2 is another perspective view of the spacer according to the disclosure.

With reference to (FIGS. 1-6, the spacer according to the disclosure, generally designated by the reference numeral 10, comprises a plate-like body 11 which is open internally with at least one spacing protrusion 12 that protrudes outward from the body 11 and defines the width of a respective gap.

The body 11 shown in the example is substantially teardrop-shaped or P-shaped, but it can also have different shapes, for example; round, square, lozenge, pentagonal, hexagonal, heptagonal, octagonal etc. as long as it has a central opening.

At least one such first spacing protrusion, designated with 13, protrudes outward and from at least one of two opposite faces of the body 11 along an arrangement that is perpendicular to the arrangement of that body 11.

In particular, the body 11 comprises three first spacing protrusions 13 which protrude from both of the opposite faces of the body 11, of which two protrude in a diametrically opposite position and one protrudes in a direction that is perpendicular to the preceding protrusions. These are also designated with 13*a* in FIG. 3 and in FIG. 4.

Substantially such three protrusions just described are configured as partitions, of the same thickness, which pass through the body 11 from one face to the opposite face.

Figure 4:
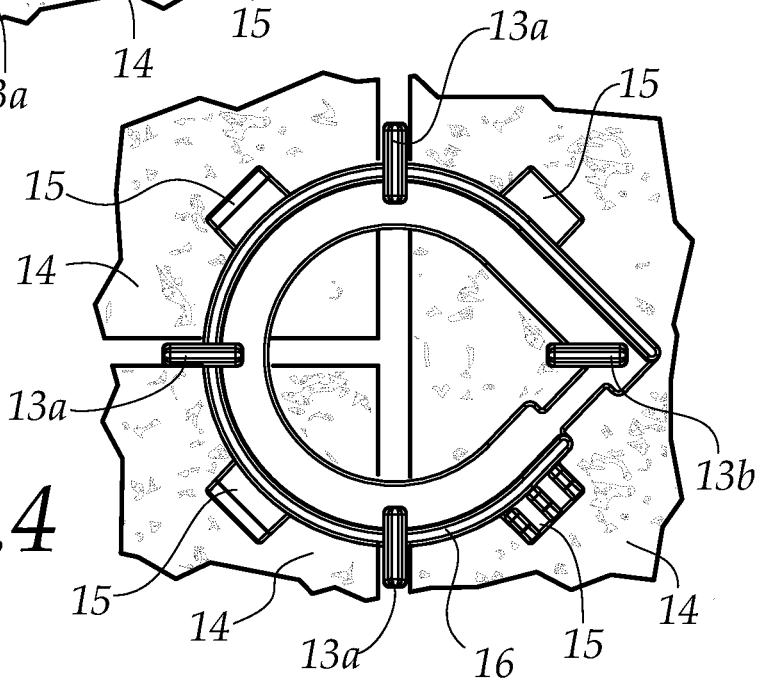
FIG. 4 is a view from above of the spacer according to the disclosure during the laying of three tiles.

As can be seen in FIGS. 1 and 4, the spacer 10 comprises four first spacing protrusions 13 which are arranged at 90° to each other, i.e. substantially in a cross, and of which three protrude from both of the opposite faces of the body 11 and one protrudes only from one of the two opposite faces. The first three are also designated with 13*a* and the other with 13*b*.

Figure 3:
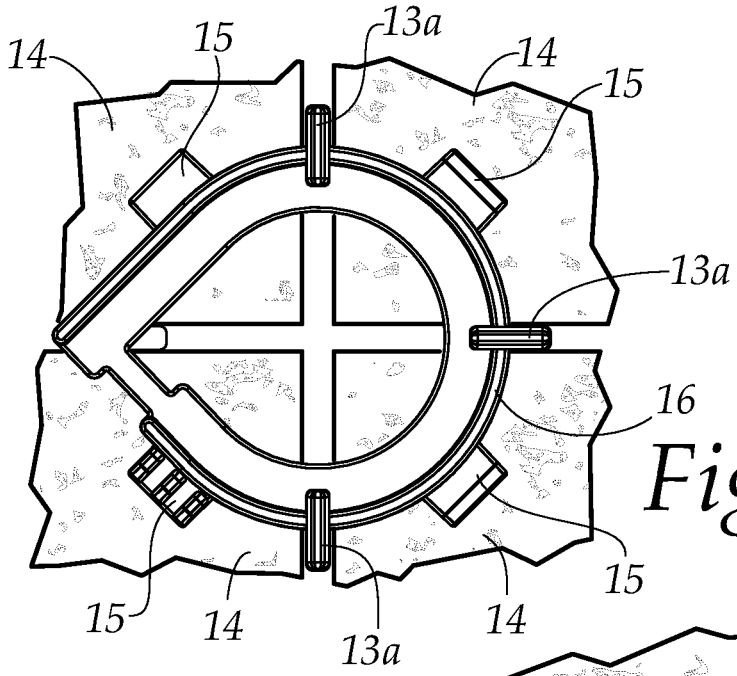
FIG. 3 is a view from above of the spacer according to the disclosure during the laying of four tiles.

FIG. 3 is a view from above of the spacer 10 during the laying of four tiles 14 in a cross.

In this first case, the upper face of the spacer 10 is the one on which only three of the first protrusions 13 are visible, although four protrusions are used, i.e. the three protrusions 13*a* plus the protrusion 13*b* which protrude from the lower face.

FIG. 4 is a view from above of the spacer 10 during the laying of three tiles 14, i.e. a T-shaped laying.

In this second case, the spacer 10 has been rotated 180° and the upper face of the spacer 10 is the one on which four first protrusions 13 can be seen, while the three protrusions 13*a* that protrude from both of the faces are used.

In both cases, the central opening of the body 11 makes the tiles 14 visible to the operator during the application of the spacer 10.

The thicknesses that define the width of the gaps are defined at the design stage and are all identical for the four elements. They can preferably be 1 mm, 2 mm, 3 mm and 5 mm, or of other dimensions as a function of the requirements.

Therefore alternative spacers exist, with which the operator can be provided for the laying of the floor covering.

The protrusions 13 protrude preferably 5 mm from the body 11. Alternatively they can protrude up to 50 mm.

The spacer 10 has at least one second spacing protrusion 15 which is substantially constituted by a tooth that protrudes radially in a cantilever fashion from the external perimeter of the body 11, along the same arrangement as that body.

There are four second spacing protrusions 15, positioned in pairs in diametrically opposing directions and in pairs at right angles.

The four second protrusions 15 have different thicknesses, preferably 1 mm, 2 mm, 3 mm and 5 mm. The thickness can also be different from the preceding values indicated, and the number of these second protrusions can be different.

The function of such second spacing protrusions 15 is to create the gap space between two tiles in linear laying.

The body 11 has a flat portion 16 for placing on the tiles 14 which protrudes on its opposite faces. Such flat portion 16 is perimetric.

Such flat portion 16 enables the spacer 10 to be placed evenly on the tiles and therefore it enables a correct leveling.

Figure 5:
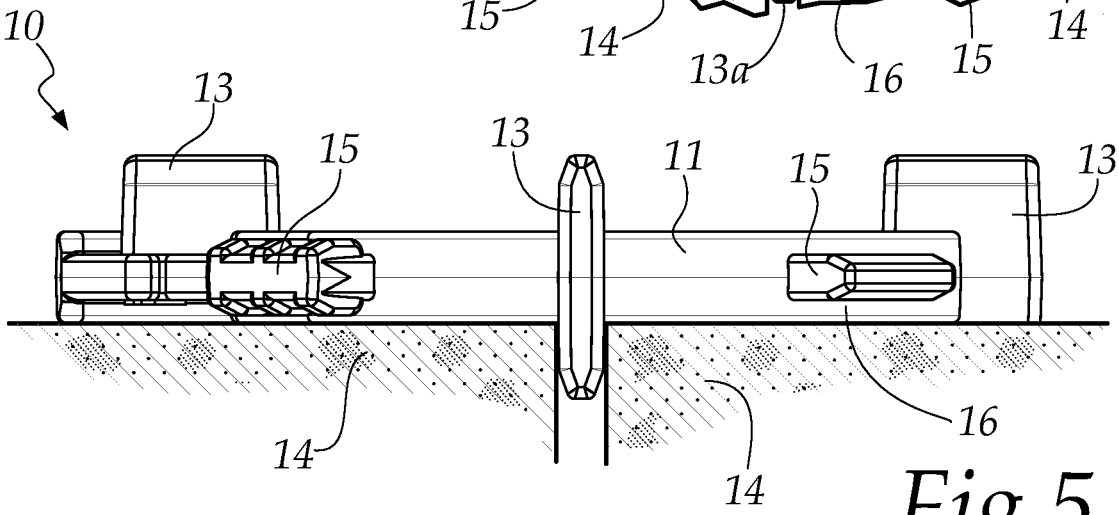
FIG. 5 is a side view of the spacer according to the disclosure during the laying of tiles.

FIG. 5 is a side view of the use of the spacer 10, from which it is clear how it makes it possible to set the distance between two tiles 14 and place the edge 16 on their surface. At the end of the laying, the spacer 10 is removed from the tiles without any part of it remaining inside the flooring surface.

Figure 6:
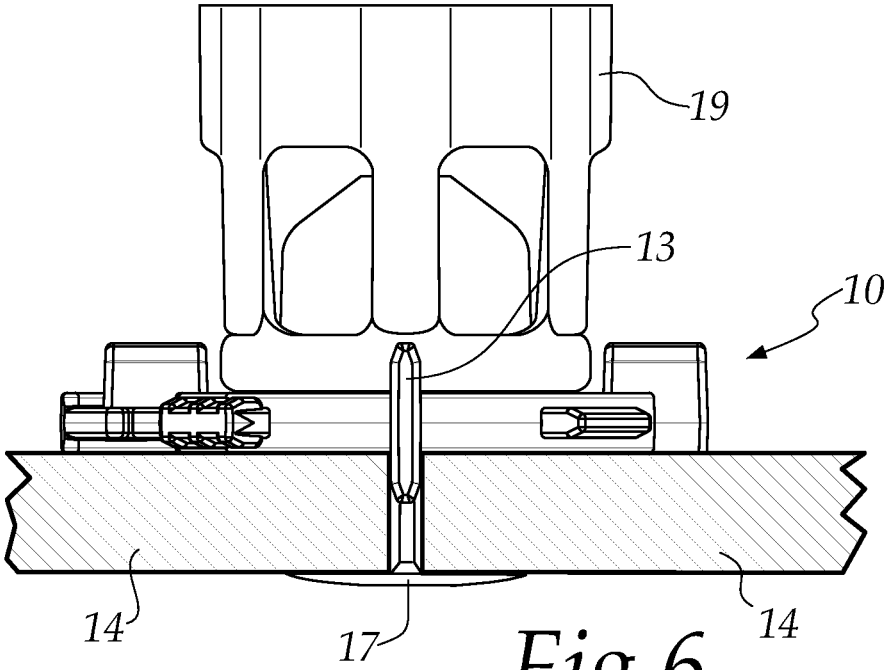
FIG. 6 is a side view of a step of laying with the spacer according to the disclosure, integrated with a conventional leveling spacer.

FIG. 6 shows the spacer 10 according to the disclosure, integrated with another leveling spacer, substantially conventional per se, which comprises:

- a base 17, to be arranged below two laterally adjacent tiles 14 and from which protrusions extend, preferably of minimum thickness 1 mm;
- a threaded stem 18, which extends at right angles at the base 17 and is connected to it in at least one facilitated breakage point;
- a knob 19 for fastening and removing the stem 18, which comprises a female threaded portion adapted to be screwed to the stem.

The spacer 10 is interposed between the upper surface of the tiles 14 and the knob 19, in order to improve the leveling.

The base 17 is substantially linear, spacing protrusions not being required in order to define the cross-shaped or T-shaped gaps, for which the protrusions 13 of the spacer 10 are used.

Figure 7:
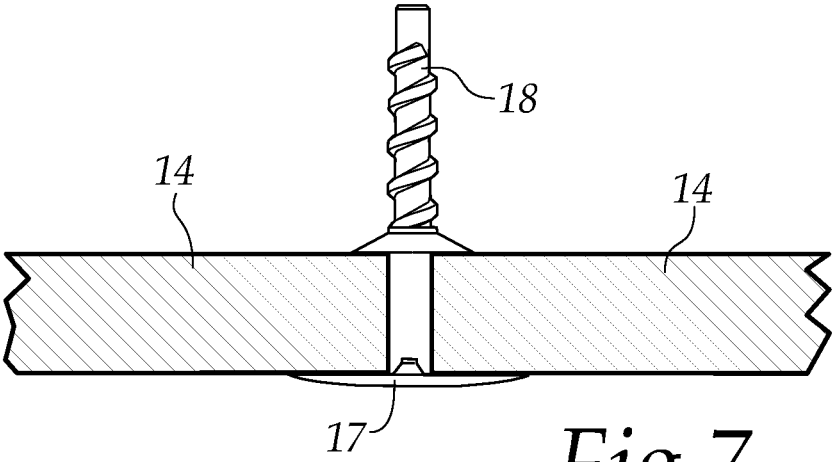
FIG. 7 shows another step of laying.

FIG. 7 shows the base 17, with the threaded stem 18, positioned below the tiles 14.

The leveling is achieved by screwing the knob 19 on the stem 18. At the end of the leveling, the knob 19 is removed, ripping the stem 18 from the base 17, and the spacer 10 is also removed.

Underneath the tiles 14 all that remains is the base 17, and no component remains in the gaps.

Use of the spacer, according to the disclosure, is evident from the foregoing description and explanation and, in particular, it is clear the ease with which it can be used, and the fact that no part of it remains inside the gaps, creating a vulnerable weak point for the correct adhesion of the laying materials.

In fact, the spacer makes it possible to correctly space apart the floor covering of tiles or bricks or the like, according to the desired gap thickness and, prior to filling, when the adhesive or other adapted material has taken hold, it can be removed.

Furthermore, the use combined with a leveling spacer in the form of a knob, like the one described, makes it possible to obtain a correct distance between the tiles and also a correct leveling.

Furthermore, the interposition of the spacer according to the disclosure between the tiles and the knob makes it possible to screw the knob onto the spacer and not directly onto the flooring surface, thus preventing dust or grains of sand from scratching the surface of the tiles.

In practice it has been found that the disclosure fully achieves the intended aim and objects by providing a spacer that is capable of ensuring the correct laying of tiles, bricks or the like, without parts that remain unrecovered inside the gaps and according to the correct leveling.

The disclosure, thus conceived, is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

What is claimed is:

1. A spacer for laying tiles, bricks and the like with the interposition of gaps, the spacer comprising: a body being open internally with at least one spacing protrusion that protrudes outward from said body and defines a width of a respective gap, wherein at least one first spacing protrusion protrudes outwardly and from at least one of two opposite faces of said body along an arrangement that is perpendicular to the arrangement of said body; wherein three first spacing protrusions protrude from both of the opposite faces of said body, two of the three first spacing protrusions protrude in a diametrically opposite position and one of the three first spacing protrusions protrudes in a direction perpendicular to the preceding protrusions; and wherein four first spacing protrusions are arranged at 90° to each other, three of the four first spacing protrusions protrude from both of the opposite faces of said body and one of the four first spacing protrusions protrudes only from one of the two opposite faces.

2. The spacer according to claim 1, wherein at least one second spacing protrusion is substantially constituted by a tooth that protrudes radially in a cantilever fashion from an external perimeter of said body, along the same arrangement as said body.

3. The spacer according to claim 1, wherein said body has at least one flat portion for placing on tiles which protrudes on its opposite faces.

4. The spacer according to claim 3, wherein said flat portion is perimetric.

* * * * *